US006135125A

United States Patent [19]

Sartena

[11] Patent Number: 6,135,125

[45] Date of Patent: Oct. 24, 2000

[54] HAIR ACCESSORY

[75] Inventor: Stacey Eve Sartena, Great Neck, N.Y.

[73] Assignee: Hair Blast, Inc., Great Neck, N.Y.

[21] Appl. No.: 09/497,098

[22] Filed: Feb. 3, 2000

[51] Int. Cl.[7] ..... A45D 8/12

[52] U.S. Cl. ..... 132/275; 132/277; 132/53

[58] Field of Search ..... 132/275, 277, 132/53, 54, 55

[56] References Cited

U.S. PATENT DOCUMENTS

| | | | |
|---|---|---|---|
| 4,830,029 | 5/1989 | Bird | 132/53 |
| 5,303,724 | 4/1994 | Anzivino | 132/275 |
| 5,501,239 | 3/1996 | Walker | 132/53 |
| 5,890,498 | 4/1999 | Kawaguchi | 132/275 |
| 5,937,867 | 8/1999 | Williams | 132/53 |
| 6,019,107 | 2/2000 | Overmyer et al. | 132/275 |

*Primary Examiner*—Todd E. Manahan
*Attorney, Agent, or Firm*—Schweitzer Cornman Gross & Bondell LLP

[57] ABSTRACT

A hair accessory device including a claw-type hair clip having claw elements hinged for opening and closing movements about an axis and carrying one or more elongated strip sections of artificial hair. Each of two claw elements has an upper panel portion adjacent to the hinge axis and from which extend a plurality of spaced apart tines, configured such that the tines of one claw element are received in the spaces between tines of the other element, when the clip is closed. A flexible bridging element extends from one upper panel portion to the other, close to but below the hinge axis. One or more elongated strip sections of artificial hair, having selvage margins at one end of strip section, are secured by such margins to the bottom surface of the flexible bridging element. In a preferred form, at least one of the elongated strip sections of hair is secured with its selvage margin extending at right angles to the hinge axis, with adjacent portions of its hair strands, within a space confined by said tines and panel portions, extending generally parallel to said axis and exiting from one end of the clip.

7 Claims, 4 Drawing Sheets

FIG. 5
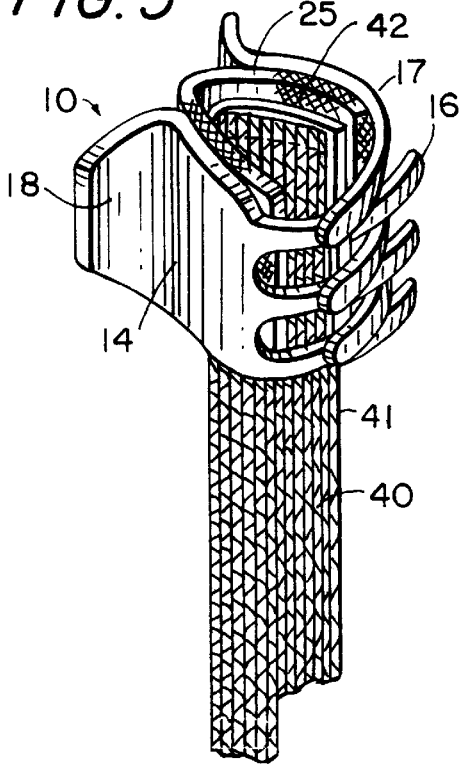
2/4
FIG. 6
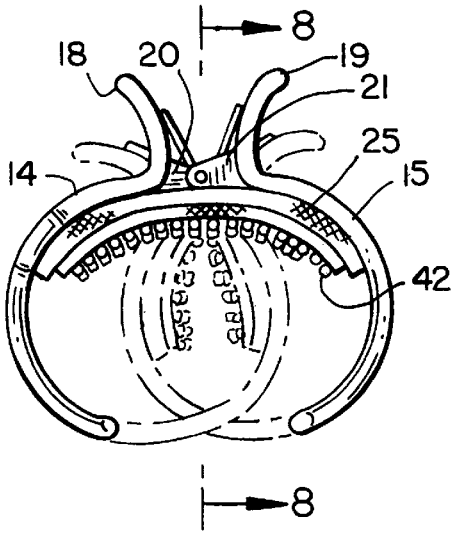
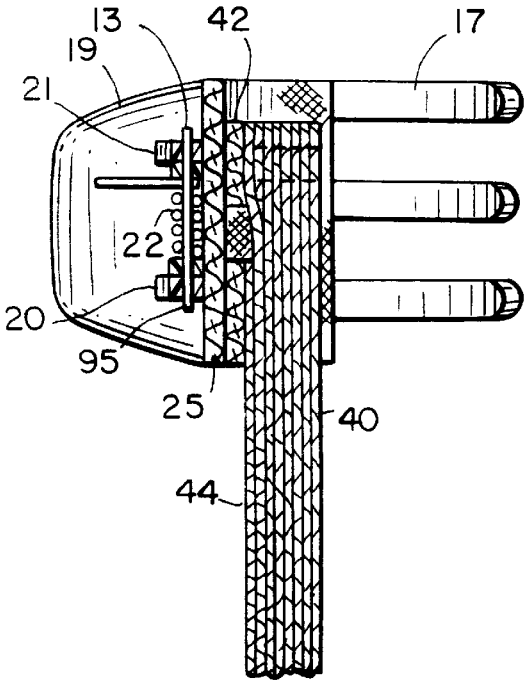
FIG. 8
FIG. 7
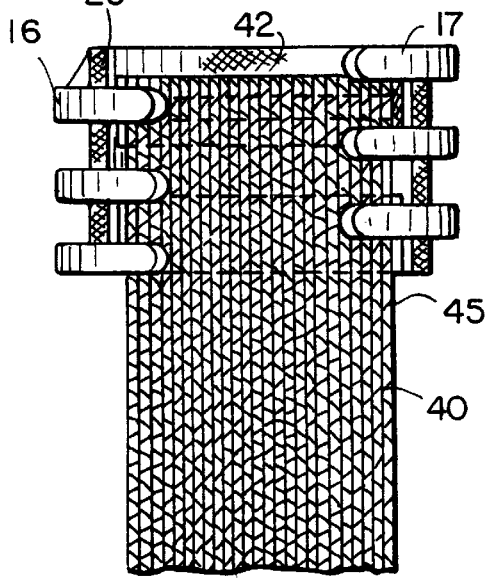

FIG. 11
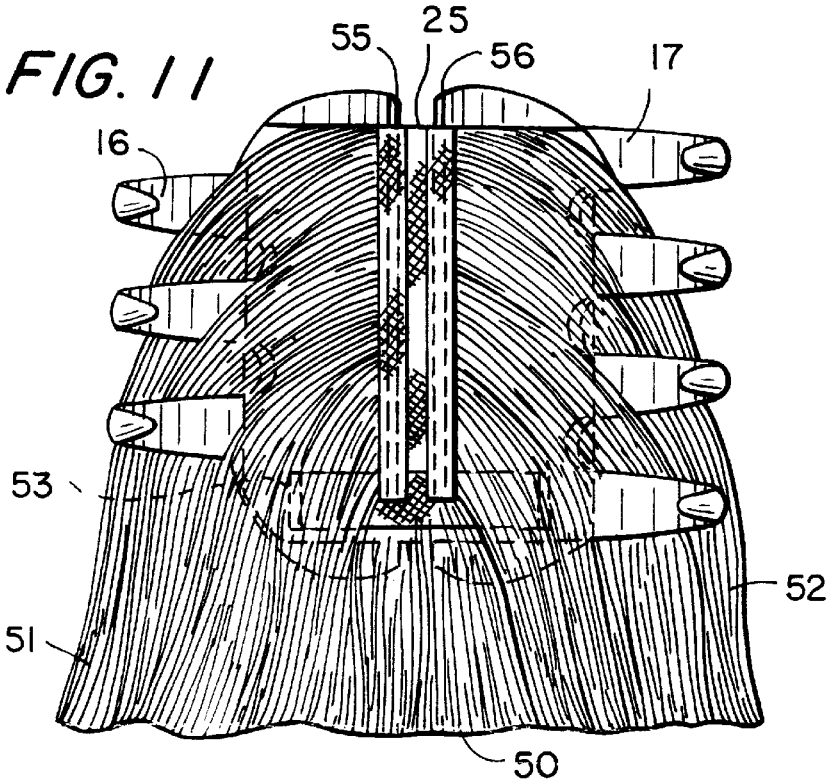
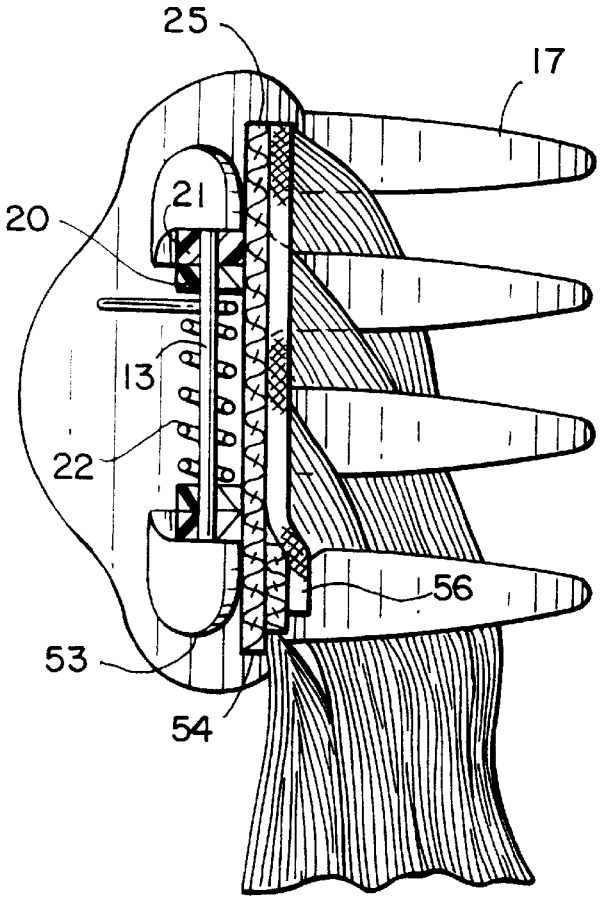
FIG. 12

HAIR ACCESSORY

RELATED APPLICATIONS

This application is closely related to my co-pending application Ser. No. 09/441,227, filed Nov. 15, 1999.

BACKGROUND AND SUMMARY OF THE INVENTION

The present invention is directed to fashion accessories for hair, and more particularly to a hair accessory which combines in a novel and advantageous manner a claw-type hair clip, itself of known design, and one or more elongated ribbon-like strips of artificial hair incorporated with the clip in a unique way to provide an especially attractive accessory device.

In the invention of my co-pending application I have combined one or more ribbon-like strips of artificial hair preferably of a type known as "track hair", with a claw-type hair clip in a manner such that end margins of the strip, similar to the selvage edge of a fabric, are secured to inside surfaces of individual ones of the pivotally connected claw elements of the hair clip. The strands of hair, forming a strip section, extend out of the clip, typically through spaces between claw tines of the clip, but additionally, or alternatively, through other openings of the clip, such as through an end opening, upwardly between the pivotally connected clip elements, or through openings formed in upper portions of the claw elements.

In the device of the present invention, arrangements are made for an elongated strip of artificial hair to be oriented with respect to the claw-type clip such that the selvage-like margin at the end of the strip is at right angles to the pivot axis of the clip, allowing the strands of hair to be aligned generally parallel with the pivot axis, and enabling the hair to exit naturally from an end of the clip. This desired orientation of the hair strip is enabled by employing a flexible bridging element, which is secured to inside surfaces of both elements of the clip and extends from one to the other below but close to the pivot axis. The flexible bridging element conceals the selvage margin of the hair strip, which can be somewhat unsightly, and provides a continuous surface for mounting of the hair strip.

In certain embodiments of the invention, hair strips may be secured to the bridging element in different orientations, for example, a first strip may be aligned with its selvage margin at right angles to the pivot axis and one or more additional strips may be oriented at right angles to the first. In other embodiments, the selvage margins of one or more strips may be aligned generally at right angles to the pivot axis of the clip, with the strands of the hair exiting the clip through one end. The strip-like sections of artificial hair may be provided as free strands or in braided or other processed form.

For a more complete understanding of the above and other features and advantages of the invention, reference should be made to the following detailed description of preferred embodiments and to the accompanying drawings.

DESCRIPTION OF THE DRAWINGS

FIG. 5 is a perspective view, similar to FIG. 1, of a second embodiment of the invention, utilizing a single strip section of artificial hair oriented with hair strands generally parallel with axis of the clip.

FIG. 6 is an end view of the device of FIG. 5, showing the clip in open position, in solid lines, and in closed position, in broken lines.

FIG. 7 is a bottom view of the device of FIG. 5, shown with the clip in the open position.

FIG. 8 is a cross sectional view as taken generally on line 8—8 of FIG. 6.

FIG. 11 is a bottom view of the device of FIG. 9, shown with the clip in the open position.

FIG. 12 is a cross sectional view as taken generally on line 12—12 of FIG. 10.

DESCRIPTION OF PREFERRED EMBODIMENTS

Figure 1:
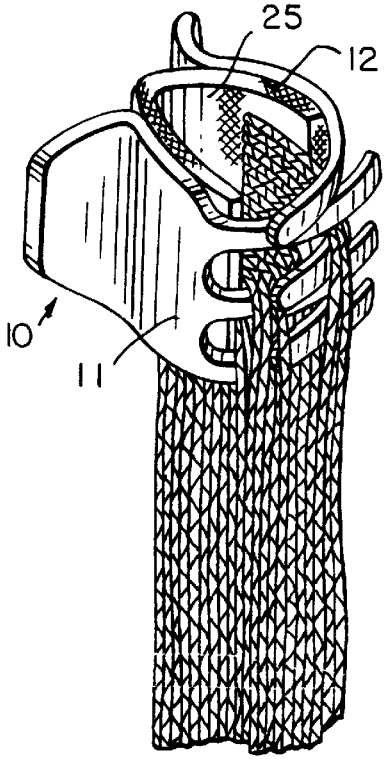
FIG. 1 is a perspective view of one preferred embodiment of the invention, with strip sections of artificial hair, in braided form, arranged in two orientations.

Referring now to the drawings, and initially to FIGS. 1–4, the reference numeral 10 designates generally a known form of claw-type hair clip, typically formed of a pair of complimentary plastic claw elements 11, 12 joined together by a hinge pin 13 defining a pivot axis. Lower portions of the clip device, as viewed in FIG. 2, include upper panel portions 14, 15, extending outward and downward from the pivot axis, and a plurality of arcuate, spaced-apart tines 16, 17.

Integral gripping elements 18, 19 extend upward from the upper panel portions 14, 15. Hinge elements 20, 21 extend from upper, inner edges of the panel portions 14, 15, and are joined by the hinge pins 13. A suitable spring 22, surrounding the hinge pin 13, has portions bearing outwardly against the gripping elements 18, 19, urging the two claw elements 11, 12 to closed positions, shown particularly in FIG. 1. A user can open the clip by engaging the gripping elements 18, 19 and pressing them together to pivot the claw elements to an open position, shown in solid lines in FIG. 2.

The general nature and construction of the clip 10, per se, is well known. The present invention resides in the adaptation of the clip device in a novel and unique manner to convert it to a highly attractive hair accessory device. To this end, a significant feature of the invention is the provision of a flexible bridging element 25, which can be in the form of a section of fabric, for example. The bridging element has a length equal to, or preferably slightly less than, the axial length of the clip device (i.e., measured in the direction of the axis of the hinge pin). The bridging element 25 is secured, typically by adhesive, to the respective upper panel portions 14, 15 of the claw elements 11, 12, and bridges the gap between them, closely adjacent to and below the hinge axis of the device. This arrangement allows the hair clip device to be opened and closed in the normal manner, with the bridging element 25 flexing in the region of the hinge pin 13.

The accessory device of the invention utilizes ribbon-like strips of pre-cut artificial hair, preferably in the form known as track hair, available from commercial suppliers of such products. Track hair is produced by placing multiple strands of hair, natural or synthetic as desired, in side by side arrangement of the strands. The side by side strands are then stitched together by a sewing machine, forming an edge structure somewhat similar to the selvage edge on woven fabrics. The track hair thus formed may have an overall length (i.e., in the direction of the track or selvage formed by the sewing machine) of as much as twenty-four inches or so. After sewing, any uneven ends, beyond the track or selvage, may be trimmed off. Pursuant to the invention, a ribbon or strip of track hair is formed by cutting a section of the track hair to provide a narrower strip or ribbon.

In the form of the invention illustrated in FIGS. 1–4, three strips of track hair are utilized, designated in the drawing by reference numerals 26, 27 and 28. In the illustrated form, the strands of artificial hair in each of the strips is in the form of individual micro braids 29, although that is a matter of style and not in any way a restrictive feature of the invention.

Figure 2:
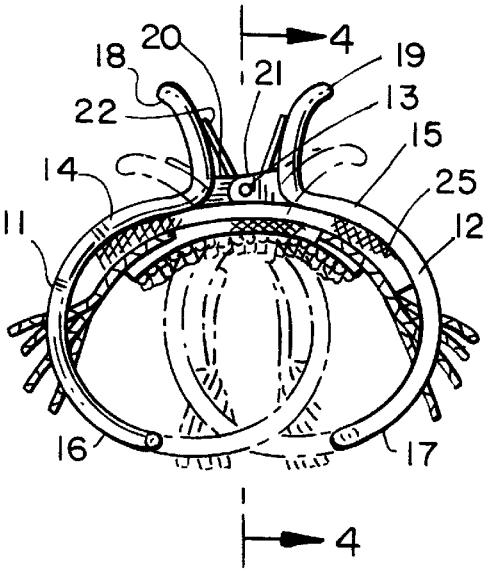
FIG. 2 is an end view of the device of FIG. 1, showing the clip in open position, in solid lines, and in closed position, in broken lines.
Figure 4:
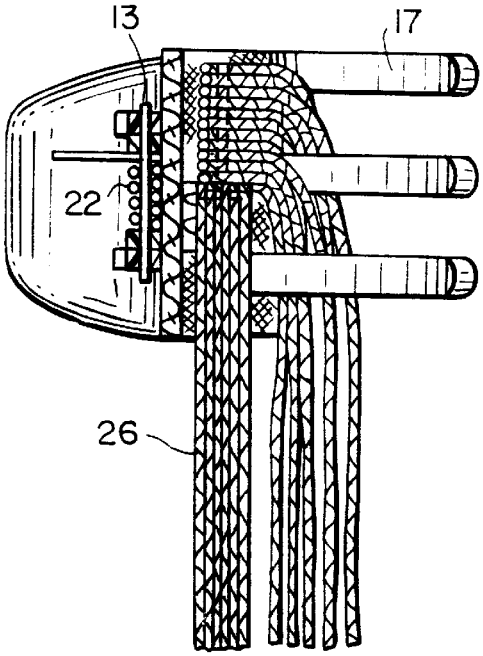
FIG. 4 is a cross sectional view as taken generally on line 4—4 of FIG. 2.
Figure 3:
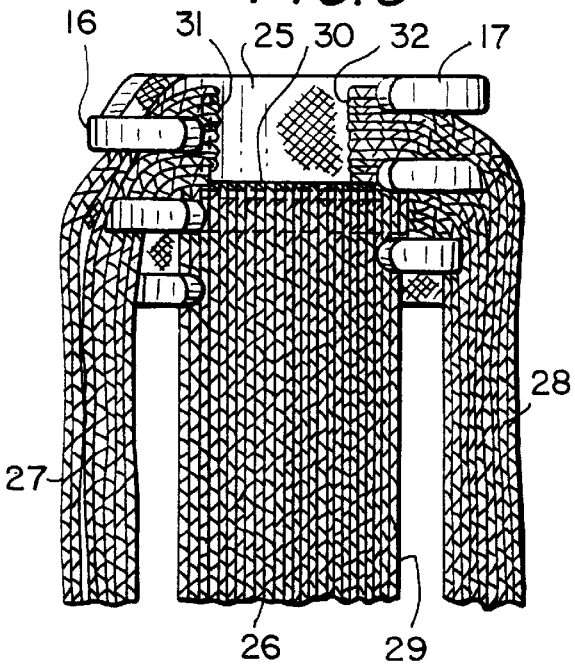
FIG. 3 is a bottom view of the device of FIG. 1, shown with the clip in the open position.

As shown best in FIG. 3, the strip 26 is oriented with its selvage edge 30 at right angles to the axis of the hinge pin 13 and secured, typically by adhesive, to the underside of the flexible bridging element 25. The arrangement is such that, when the clip is in the general orientation shown in FIGS. 1 and 3, the hair strands of the strip section 26 exit naturally from one end of the clip. The width of the strip 26 advantageously is such, as shown in FIG. 2, that it completely spans, and preferably extends well beyond, the gap between the two claw elements 11, 12.

The second and third strip sections 27, 28 are oriented with their respective selvage edges 31, 32 generally parallel to the pivot axis, with each of the selvage edges being adhesively secured to the bridging element 25, preferably in the area of the upper panel portions 14, 15, as particularly shown in FIGS. 2 and 3. Preferably, the selvage edges 31, 32 are secured directly to the under surface of the bridging element 25 and the selvage 30 of the central strip section 13 overlaps the selvages 31, 32 at opposite sides of the strip 26. The strands or braids 29 of the lateral strips 27, 28 are arranged to drape through spaces between the tines 16, 17 of the clip elements.

With reference now to FIGS. 5–8, the illustrated clip and bridging element is the same as for FIGS. 1–4, and corresponding reference numerals utilized. In the embodiment of FIGS. 5–8, only a single strip 40 of artificial hair is utilized (or a plurality of strips with the same orientation). The strip is oriented such that its strands 41 (which are braids in the illustration), are generally aligned with the axis of the clip and exit from one end of the clip, as indicated in the drawing. The selvage edge 42 of the hair strip is adhesively bonded to the flexible bridging element 25, and preferably extends substantially over the full width of the bridging element.

In the embodiment of FIGS. 5–8, the selvage edge 42 of the hair strip advantageously is positioned near the "upper" end of the clip, as indicated in FIG. 5. In as much as the selvage area is relatively narrow, a number of options are available, one of which is to install a plurality of hair strips spaced axially along the length of the flexible bridging element 25. For example, as illustrated particularly in FIG. 8, a first strip 40 can be installed by securing its selvage area 42, near the upper end of the clip as shown in FIG. 8, and a second strip 44 secured by its selvage 45, positioned below the first selvage edge and adhesively secured to the bridging element 25. It is also possible to bond a plurality of strands one directly over the top of the other, with the innermost strand being bonded to the flexible bridging element.

In the embodiment of FIGS. 9–12, the illustrated clip is of slightly different design, although constructed of essentially similar components, which again will be identified by reference numerals corresponding to those used in FIGS. 1–8. The embodiment of FIGS. 9–12 utilizes multiple strips 50–52 of free flowing hair adhesively secured to a flexible bridging element 25. In turn, the bridging element is adhesively or otherwise secured at its side edges to upper panel portions 14, 15 of the clip and bridges across the gap between the respective clip elements 11, 12 directly underneath the pivot pin 13.

The hair making up the hair strips used in various embodiments of the invention may be either natural hair, cut from donors, or synthetic hair. Where micro braids are employed, as indicated in the embodiments of FIGS. 1–8, synthetic hair may be preferred. Natural hair may be preferred where the hair strands are free flowing, as in the embodiment of FIGS. 9–12.

As indicated in FIG. 11, the hair strand 50 is oriented with its selvage portion 53 oriented at right angles to the pivot axis of the clip. The selvage is adhesively secured preferably directly to the under surface of the flexible bridging element 25, adjacent to the lower edge 54 thereof. The individual strands of hair of the strip 50 thus are oriented generally parallel to the hinge axis of the clip and exit in that orientation from the lower end of the clip.

It will be understood, of course, that the individual strands of hair are free flowing and entirely flexible, such that their orientation outside of the area of the clip is influenced by a variety of factors, including the orientation of the clip when worn. The strands of hair in the immediate area of the selvage, confined within the interior of the clip, will tend to be oriented more or less in the manner described.

The hair strips 51, 52 are mounted to the flexible bridging element 25 with their respective selvage portions 55, 56 oriented generally parallel to the pivot axis. As previously mentioned, multiple strands of hair may be employed, applied one on top of the other or in a shingled arrangement, etc. depending upon the fullness of the hair desired.

Figure 9:
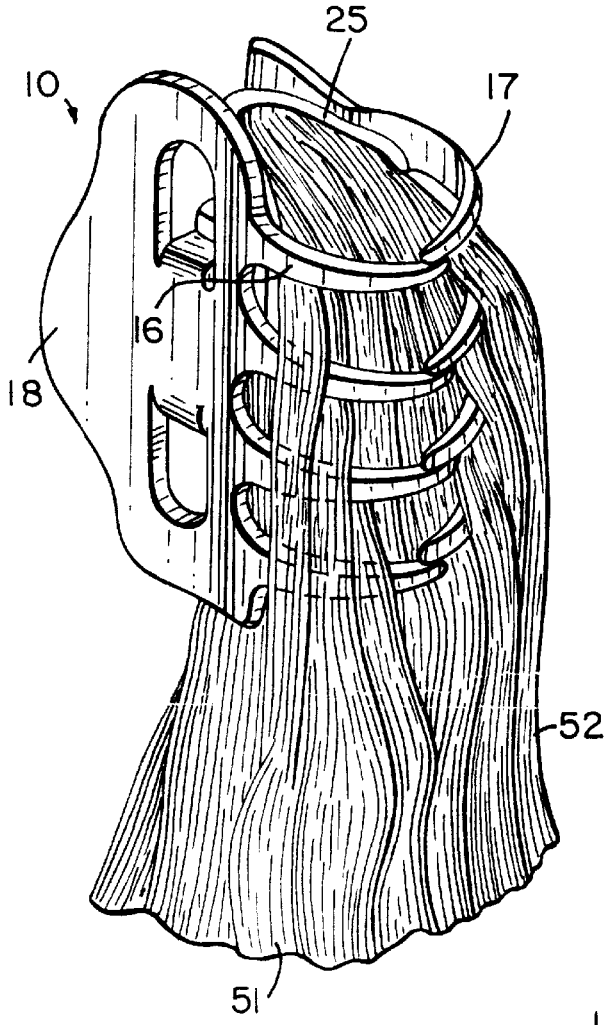
FIG. 9 is a perspective view of third preferred embodiment of the invention, with strip sections of artificial hair, in free strand form, arranged in two orientations.
Figure 10:
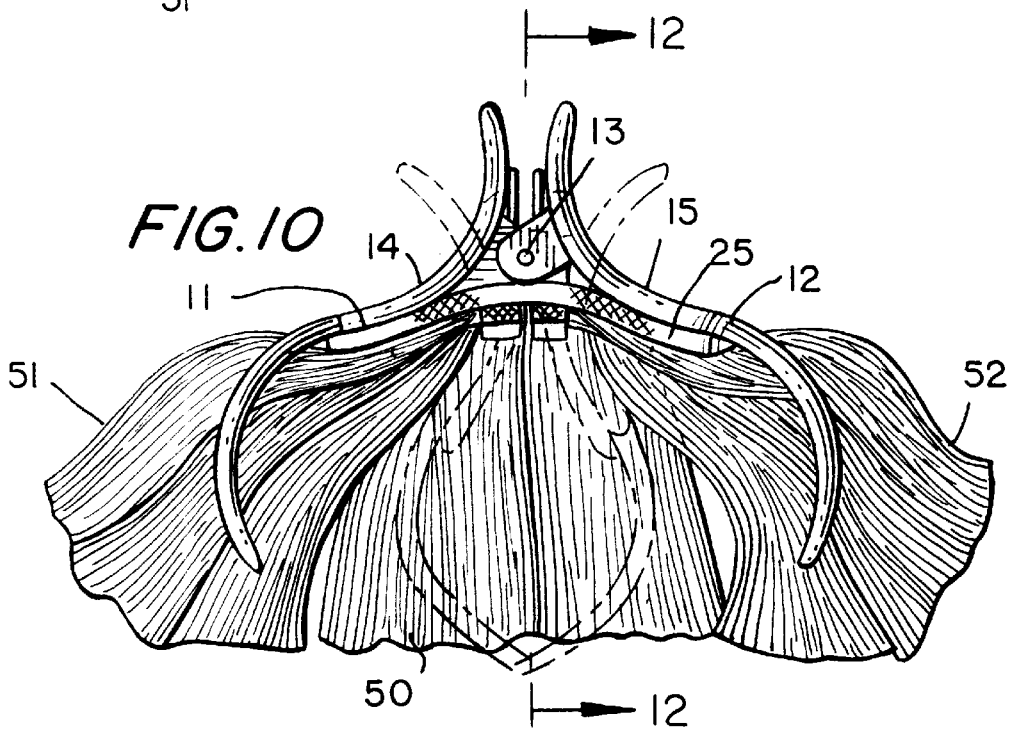
FIG. 10 is an end view of the device of FIG. 9, showing the clip in open position, in solid lines, and in closed position, in broken lines.

As shown particularly in FIGS. 9 and 11, the strands of hair from the hair strips 51, 52 desirably are led laterally outward through spaces between the respective tines 16, 17.

In general, it is contemplated that the hair accessory of the invention will be worn at the back of the head, in a generally upright orientation, such that the strands of hair emanating from the clip are somewhat in the nature of a ponytail.

The device of the invention provides an extraordinarily attractive hair adornment by providing a practical and attractive arrangement for mounting strips of artificial hair, particularly strips oriented with the selvage edge at right angles to the pivot axis.

A significant feature of the present invention is the utilization of a flexible bridging member, which is secured to the interior of the clip and extends from upper panel portions of the respective clip elements, bridging the space between them underneath but closely adjacent to the pivot axis of the clip. The provision of the bridging element provides for a great deal of flexibility in the mounting and arrangement of hair strips, in particular accommodating the mounting of strips with selvage edges oriented at right angles to the pivot axis. Additionally, the flexible bridging element improves the aesthetics of the device by concealing the strips of artificial hair within. The bridging element may be appropriately colored to closely match the color of the clip, for example, so that it is not readily evident.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. A hair accessory which comprises, (a) a claw-type clip comprising first and second claw elements engaged for pivoting movement along a predetermined axis, (b) each claw element having, on one side of said axis, an upper panel portion and a plurality of spaced apart tines extending downward and inward from said panel portion, (c) the tines of one claw element positioned to enter spaces between tines of the other claw element when said clip is in a closed position, (d) each of said claw elements having a gripping portion located on the opposite side of said axis from said tines, (e) a bridging element of flexible material secured to the upper panel portions of each of said claw elements and extending therebetween, adjacent to and below said axis, and (f) an elongated strip section of artificial hair having a selvage margin at one end and disposed generally at right angles to the direction of individual strands of said artificial hair, (g) said selvage margin being secured to a bottom surface of said flexible bridging element.

2. A hair accessory according to claim 1, wherein (a) said selvage margin is oriented at right angles to said axis and extends from the upper panel portion of one claw element to the upper panel portion of the other claw element, and the strands of hair, within a space confined by said tines and upper panel portions, extend in a direction generally parallel to said axis.

3. A hair accessory according to claim 2, wherein (a) the strands of hair of said strip section at least in part extending through spaces between tines of said claw elements.

4. A hair accessory according to claim 2, wherein (a) a plurality of strip sections of hair are secured to said flexible bridging element, (b) the selvage margin of each such strip section being oriented at right angles to said axis.

5. A hair accessory according to claim 1, which includes (a) a pair of elongated strip sections of artificial hair, each having a selvage margin at one end and disposed generally at right angles to the direction of individual strands of said artificial hair, (b) the selvage margins of said hair strips being secured to the bottom surface of said flexible bridging element on opposite sides of axis, with said margins being oriented generally parallel to said axis.

6. A hair accessory according to claim 5, which includes (a) a third elongated strip section of artificial hair having a selvage margin at one end disposed generally at right angles to the direction of individual strands of said artificial hair, and (b) said last mentioned selvage margin is oriented at right angles to said axis and extends from the upper panel portion of one claw element to the upper panel portion of the other claw element, and the strands of hair of said third strip section, within a space confined by said tines and upper panel portions, extend in a direction generally parallel to said axis.

7. A hair accessory according to claim 6, wherein (a) the strands of hair of said pair of strip sections at least in part extending through spaces between tines of said claw elements.

* * * * *